US009194264B2

(12) United States Patent
Khajepour et al.

(10) Patent No.: US 9,194,264 B2
(45) Date of Patent: Nov. 24, 2015

(54) SYSTEMS AND METHODS FOR VARIABLE VALVE ACTUATION

(76) Inventors: Amir Khajepour, Waterloo (CA); Mohammad Pournazeri, Waterloo (CA)

( * ) Notice: Subject to any disclaimer, the term of this patent is extended or adjusted under 35 U.S.C. 154(b) by 10 days.

(21) Appl. No.: 14/234,433

(22) PCT Filed: Aug. 9, 2012

(86) PCT No.: PCT/CA2012/050539

§ 371 (c)(1),
(2), (4) Date: Jan. 23, 2014

(87) PCT Pub. No.: WO2013/020232

PCT Pub. Date: Feb. 14, 2013

(65) Prior Publication Data

US 2014/0190429 A1 Jul. 10, 2014

Related U.S. Application Data

(60) Provisional application No. 61/573,025, filed on Aug. 9, 2011.

(51) Int. Cl.

| | |
|---|---|
| ***F01L 9/02*** | (2006.01) |
| ***F01L 1/344*** | (2006.01) |
| ***F01L 25/02*** | (2006.01) |

(52) U.S. Cl.

CPC ..... *F01L 9/021* (2013.01); *F01L 1/344* (2013.01); *F01L 9/02* (2013.01); *F01L 25/02* (2013.01); *F01L 2820/032* (2013.01)

(58) Field of Classification Search

CPC ..... F01L 9/021; F01L 25/02; F01L 1/344; F01L 9/02; F01L 2820/032

USPC ..... 123/90.12

See application file for complete search history.

(56) References Cited

U.S. PATENT DOCUMENTS

| | | | | |
|---|---|---|---|---|
| 5,562,070 | A * | 10/1996 | Schechter et al. | 123/90.12 |
| 6,173,684 | B1 | 1/2001 | Buehrle, II et al. | |

FOREIGN PATENT DOCUMENTS

| | | | |
|---|---|---|---|
| DE | 3741214 | | 6/1989 |
| DE | 19931129 | A1 * | 1/2000 |
| GB | 2124701 | | 2/1984 |
| JP | 61085514 | | 5/1986 |
| JP | 3206310 | | 9/1991 |
| WO | 2005038201 | | 4/2005 |

OTHER PUBLICATIONS

Abstract of DE19931129A1 listed above, Jan. 2000.*

PCT International Searching Authority, International Search Report for International Patent App. No. PCT/CA2012/050539, Oct. 10, 2012.

* cited by examiner

*Primary Examiner* — Zelalem Eshete

(74) *Attorney, Agent, or Firm* — Gowling Lafleur Henderson LLP; Jeffrey W. Wong

(57) ABSTRACT

The disclosure is directed at a valvetrain actuation (VA) system for an engine comprising at least two hydraulic rotary valves connected to an engine crankshaft, at least one hydraulic actuator driven by the at least two hydraulic rotary valves, and a high pressure hydraulic fluid source for supplying hydraulic fluid to one of the at least two hydraulic rotary valves, wherein movement of the at least two hydraulic rotary valves by the engine crankshaft allows hydraulic fluid to flow to the at least one hydraulic actuator to actuate an engine valve.

15 Claims, 11 Drawing Sheets

SYSTEMS AND METHODS FOR VARIABLE VALVE ACTUATION

FIELD

The present disclosure relates generally to valvetrain systems. More particularly, the present disclosure relates to systems and methods for variable valve actuation.

BACKGROUND

Poppet valves are used in combustion engines to open and close intake and exhaust ports located in the engine cylinder head. These valves usually consist of a flat disk with a tapered edge rigidly connected to a long rod at one end, called a valve stem (shank). The valve stem is used to push down or pull up the valve against the tapered seat during opening and closing stages. A retaining spring is usually used to close the valve when the stem is not being pushed on. In conventional valvetrain system, the valve is raised from its seat by pushing the stem using a cam-follower mechanism. The cam profile and its location with respect to the cam follower determine the valve translational motion as well as its opening and closing timings. In the conventional designs, the camshaft is placed relatively close to the crankshaft and the translational motion from the cam follower is transferred to the valve stem through pushrods or rocker arms. This mechanism is very common in V-type engines and allows for the actuation of the valves of both cylinder banks using a common camshaft.

Conventional designs have considerable energy losses in the engine. The cams are usually fixed on the camshaft and rotate with the same speed as the camshaft. The camshaft obtains its rotary motion from the engine crankshaft using an intermediate mechanism such as chain, gear or belt. The camshaft speed is half the crankshaft speed in 4-stroke engines and equal to that in 2-stroke engines.

In addition to zero flexibility of the cam-follower valvetrains, another drawback of the cam-driven valvetrains is that the minimum possible engine valve opening angle ($\beta$) is limited due to the cam profile limitations. In a cam with flat faced follower, a negative radius of curvature on the cam cannot be accommodated and this limits the minimum cam rise or fall angle ($\beta/2$) for a specific cam size.

Significant improvement in power density, volumetric efficiency, emission and fuel consumption can be achieved by variable valve actuation systems (VA).

In general, VA systems are divided into two main categories: camless and cam-based valvetrains. In the camless systems, there is no mechanical connection between the engine crankshaft and the valvetrain. High level of flexibility in valve timing and valve lift is the main advantage of these systems over cam-based valvetrains. Electro-mechanical, electrohydraulic and electro-pneumatic valvetrains are all in this category. Although these systems are the most flexible valve actuation systems, some concerns including high cost, low reliability (i.e. not being fail-safe), high power consumption (>2.2 kW for 16 valve engine at 5000 rpm engine speed), high seating velocity (>100 mm·s−1) and control complexity (requires ultra fast actuator with response time of less than 3 ms) prevent these systems from being incorporated into production engines.

In contrast to camless valvetrains, the cam-based VA systems are mechanically linked to the engine crankshaft. Due to their high reliability, durability, repeatability and robustness, many of these systems have been already designed and implemented in production engines. Limited flexibility and high mechanism complexity are the major disadvantage 5 of the cam-based valvetrains compared with the existing camless systems.

Cam phaser is a standard mechanism for valve timing. By using this mechanism, it is possible to change the cam angular position relative to the crankshaft and consequently shift the valve opening and closing events simultaneously. However, using this mechanism, the total engine valve opening duration and lift remain constant. Cam phasers are categorized into oil actuated, helical gear drives, differential drives, chain drives, worm gear drives and planetary gear drives.

Cam Profile Switching (CPS) is another technique introduced by Honda to vary valve timing, duration and lift simultaneously. In this technique, the valve motion is switched between two different sets of cam lobs. During low engine speed operation, the cam with low lift profile is engaged with the valve stem, while at high engine speed operation, the cam with high lift profile is engaged. The shift from one cam to another is realized by either an electric or hydraulic system. In this system, the cam profiles are compromised settings for the desired objectives during two engine speed ranges.

One of the problems of cam profile switching is that the valve motion is switched only between two specific cam profiles. However, the use of a three-dimensional cam design allows the engine to continuously change the valve timing, lift and duration over a wide range of engine operating conditions. In this mechanism, the cam profile continuously varies along the cam axis, and the axial movement of the camshaft with respect to follower brings a different profile of the cam into engagement with the follower, prompting a change in valve opening profile. A combination of three-dimensional cam mechanism and cam phaser has been also implemented by Nagaya et al. to control both valve timing and valve lift independently.

Electromagnetic valve actuation systems generally consist of two magnets and two balanced springs. The moving parts of the electromagnetic valve are connected to the engine valve. When both magnets are off, the armature is held in the intermediate position between the coils by balanced springs.

At engine start-up, the upper electromagnet is activated and it pulls up and holds the armature, and the potential energy is stored in the retaining springs. To open the valve, the upper electromagnet is deactivated and the stored energy is released and converted into kinetic energy which carries the armature toward the lower magnet. At a distance of less than one millimeter from the lower magnet, the moving part is captured and held. During the valve closing stage, similar events are repeated. Due to high non-linearity in magnetic force characteristics, there are several difficulties preventing this technology. from being commercially implemented [30]. These difficulties include: High landing velocity (>0.5 msec at 1500 rpm), High transition time (>3.5 msec), Higher power losses than conventional cam drive system, Requirements for robust feedback control, High sensitivity to in-cylinder gas pressure.

A basic electro-hydraulic camless valvetrain consists of a hydraulic cylinder, two solenoid valves and two check valves. In this design, the solenoids and the check valves control the submission and rejection of the high pressure oil into and out of the hydraulic cylinder during valve operation. Using an additional oil path, a constant force is always applied to the bottom of the piston, and when the high pressure oil is removed from the piston top, the valve returns to its seated position. By controlling the solenoid valves timing and opening duration, it is possible to precisely control the valve timing, duration, and lift. By activating the high pressure solenoid valve, the high pressure oil is admitted into the hydraulic cylinder. The opening period of this high pressure solenoid valve determines the amount of oil submitted into the cylinder chamber and consequently determines the valve lift. By activating the low pressure solenoid valve, the oil is discharged from the upper cylinder chamber thanks to the presence of high pressure oil at the lower chamber. The low pressure solenoid valve opening duration determines how far the valve moves in its closing descent.

Similar to electro-mechanical valve systems, a closed loop electronic control is required to reduce valve seating velocity, transition time, and cyclic variability. One of the problems of this VVT system is servo-valve response time. Due to solenoid coil inductance and nonlinear force to displacement relation, the solenoid maximum operating frequency is reduced and, as a result, the system shows poor performance during high engine speeds.

The required valve actuation time reduces significantly as engine speed increases, and consequently the minimum valve opening angle becomes limited. For example, at an engine speed of 6000 rpm and a total opening angle of 100 degrees, the total time available for the actuation process is about 3 ms, which almost exceeds the speed of the high bandwidth solenoid valves which are currently on the market. This causes the electrohydraulic valve manufacturers to use either a double-stage mechanism (i.e., two pilot valves) or employ ultra high frequency actuators such as piezoelectric.

In electro-hydraulic VA systems, the major part of the system cost is for high speed servo-valves which control the oil flow to and from the hydraulic cylinder. A high speed servo valve may be split into a digital three-way valve and two proportional valves. The digital three-way valve directs hydraulic fluid either from a high pressure source toward the hydraulic cylinder or from the hydraulic cylinder to the reservoir. However, the two-way proportional valves control the valve timing, valve rise/fall duration, final valve lift and valve velocity.

An electro-hydraulic valvetrain has been proposed by Brader et. al in which the solenoid actuators are replaced with piezoelectric stacks. The proposed system is capable of having maximum valve lift of 12.4 mm and bandwidth frequency of up to 500 Hz. In this mechanism, an electric signal sent from a control system causes a piezoelectric stack to expand. This linear expansion is transferred to the spool valve via a solid hinge mechanism. The reason for using this mechanism is to overcome the displacement limitations in the piezoelectric stacks while maintaining its efficiency and operating frequency. Using this mechanism, the movements of the stacks can be amplified from 30 μm to 150 82 m, which is sufficient for spool valve actuation.

In addition to electro-hydraulic and electro-mechanical valvetrains, electro-pneumatic variable valve actuation systems are proposed. The combination of hydraulic and pneumatic mechanisms allows the system to extract maximum work from the air flow and thus it can function under low air pressure. To reduce the energy consumption and also control valve seating velocity, a hydraulic latch was also employed in this system. This mechanism is capable of controlling valve lift, valve timing, and opening duration as desired by the engine.

One of the main problems of this system is its high dependency on the in-cylinder gas pressure. Due to low working pressure of this system compared to hydraulic systems and gas compressibility, the valve opening and closing are highly affected by the engine in-cylinder pressure. Thus, having pre-knowledge of the cylinder pressure and also solenoid response time is necessary to predict the exact timing of solenoid activation or deactivation. The solenoids response time also limits the system's bandwidth.

SUMMARY

It is an object of the present disclosure to obviate or mitigate at least one disadvantage of previous engine valve systems.

In a first aspect, the present disclosure provides a valvetrain actuation (VA) system for an engine comprising at least two hydraulic rotary valves connected to an engine crankshaft; at least one hydraulic actuator driven by the at least two hydraulic rotary valves; and a hydraulic fluid source for supplying hydraulic fluid to one of the at least two hydraulic rotary valves; wherein movement of the at least two hydraulic rotary valves by the engine crankshaft allows hydraulic fluid to flow to the at least one hydraulic actuator to actuate an engine valve.

In a further embodiment, there is provided a method of hydraulically controlling an engine valve comprising supplying pressurized hydraulic fluid to one of at least two hydraulic rotary valves; driving the at least two hydraulic rotary valves with an engine crankshaft; wherein the driving of the at least two hydraulic rotary valves causes the one of the at least two hydraulic rotary valves to supply the hydraulic fluid to at least one hydraulic actuator to actuate an engine valve in a first direction.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Figure 1:
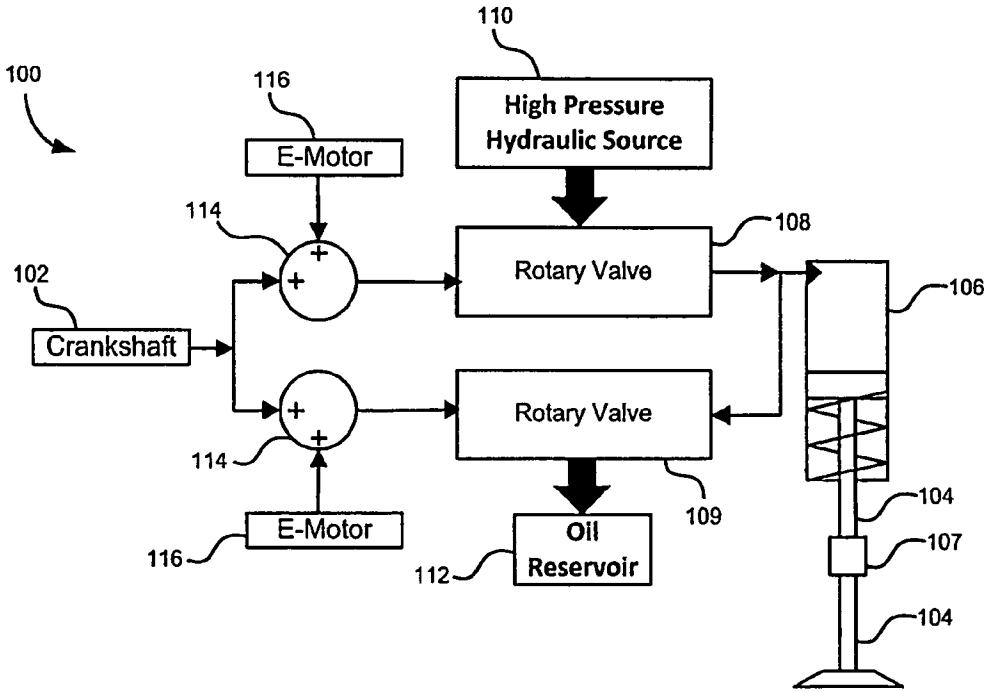
FIG. 1 is a flowchart of a variable valve actuation system, in accordance with an embodiment.

Generally, the present disclosure provides systems and methods for variable valve actuation. Valvetrain systems, in automotive engine applications, are designed to accurately control the admission and rejection of intake and exhaust gases to an engine cylinder within each cycle. Conventional cam-follower mechanisms have been the primary means of engine valve actuation. In cam-based systems, the engine valves open and close with a fixed lift and timings, providing reliable and accurate valve operation during various speed ranges. However, the engine cannot be operated at its most efficient performance over wide range of speed and load. Because the dynamic behavior of gas flow in a cylinder varies over different operating conditions, fixed valve timing is always a compromised setting for a given design goal. Hence, some desirable performance characteristics such as minimum emission or fuel consumption are sacrificed for other requirements such as maximum power and torque.

Varying the engine valve event duration, timing and/or lift provides a method of improving engine performance, lowering exhaust emission. Optimizing the engine valve timing at all engine loads and speeds significantly improves engine efficiency, power, torque, smoothness and cleanness. A minimum engine efficiency improvement of about 15% over typical driving cycles has been observed using variable valve timing systems and a potential of up to 20% improvement has been estimated.

Applying flexible engine valve actuation technology in different types of engines have certain advantages. For gasoline engines there is a reduction in pumping losses by wide open throttle (WOT) through controlling the intake valve opening duration and there is improvement in brake mean effective pressure (BMEP) throughout the speed range by controlling intake valve closing (IVC). For diesel engines there is cylinder deactivation and engine torque improvement, increased turbocharger efficiency improvement by optimizing intake valve closing and exhaust valve opening timings, NOx emission reduction by internal exhaust gas recirculation (iEGR), improvement in catalyst efficiency by influencing the temperature, and reduction of particulate matters (PMs) by optimizing intake charging. For an air hybrid engine there is an achievement of three modes of operation including regenerative braking, air motor, and conventional combustion modes.

Conventional variable engine valve actuation systems (VA) are either cam-based or cam-less. Limited degrees of control freedom are allowed by cam-based VAs while significantly complex as well as heavy and expensive mechanical systems have to be adopted. On the other hand, camless valvetrains offer unlimited and programmable flexibility of engine valve motion owing to the use of engine independent actuators; however, sophisticated control systems are required in order for the camless valvetrain to operate properly. Low reliability, poor repeatability, high engine valve seating velocity and high power consumption are other significant factors affecting the applicability of these systems in production engines.

Figure 11:
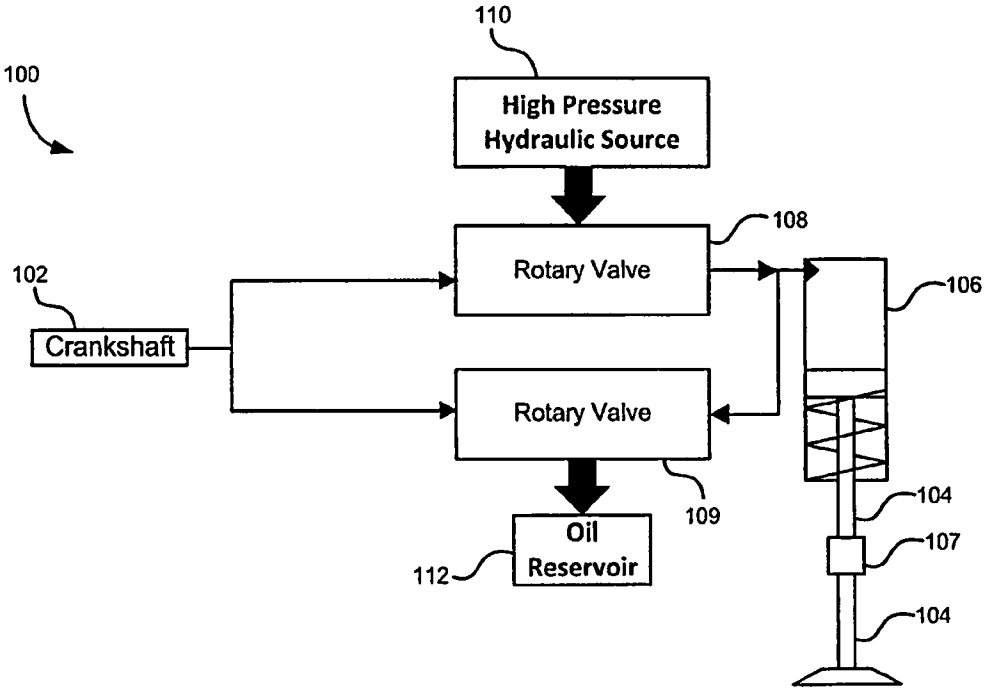
FIG. 11 is a schematic diagram of another embodiment of a valvetrain actuation system.

FIG. 1 illustrates a schematic diagram of a hydraulic valve actuation (VA) system. The VA system 100 is connected to an engine crankshaft 102, typically camless, which is connected to a pair of phase shifters 114, which in turn, are connected to individual hydraulic rotary valves, seen in the current embodiment as hydraulic rotary spool valves 108 and 109. Control of the phase shifters 114 may be via separate e-motors 116 or may be controlled by a single e-motor 116. In another embodiment, the engine crankshaft may be connected directly to the hydraulic rotary valves 108 and 109 as shown in FIG. 11.

The rotary spool valves 108 and 109 may be any type of valve having a rotary input and an alternating hydraulic control output and may, in one embodiment, be seen as a high pressure rotary spool valve or HPSV (valve 108) and a low pressure rotary spool valve or LPSV (valve 109). The HPSV 108 is connected to a high pressure hydraulic fluid source 110 which while the LPSV 109 is connected to a low pressure hydraulic source or an oil reservoir 112. In an alternative embodiment, the oil reservoir 112 and the high pressure fluid source 110 may be the same part. In operation, the high pressure hydraulic fluid source 110 provides fluid to the HPSV 108 while the low pressure hydraulic source 112 receives fluid from the LPSV 109. The two rotary spools 108 and 109 are also connected to a hydraulic actuator or a hydraulic cylinder 106, such as a single-acting spring return hydraulic cylinder, which is associated with an engine valve 104. In the embodiment of FIG. 1, the hydraulic actuator is coupled via a coupler 107 to the valve 104 but alternatively, the valve 104 may also be integrated within the actuator 106. As understood, the hydraulic actuator 106 actuates the engine valve 104 of an engine 120 which is connected to a piston of the hydraulic cylinder 106.

In operation, the rotary spool valves 108 and 109 charge and discharge, respectively, the hydraulic cylinder as will be described below with respect to the various operational stages of the system. In one embodiment, the phases of the rotary spool valves 108 and 109 are controlled by the individual phase shifters 114 whereby each phase shifter 114 may be seen as a differential gearbox.

In the current embodiment, the VA system 100 is capable of flexible engine valve timings (0-720 CA°) and lift (0-12 mm) at any engine speed (600-6000 rpm) without the drawbacks of existing camless valvetrains such as high control complexity, low reliability and slow actuator response.

Figure 2:
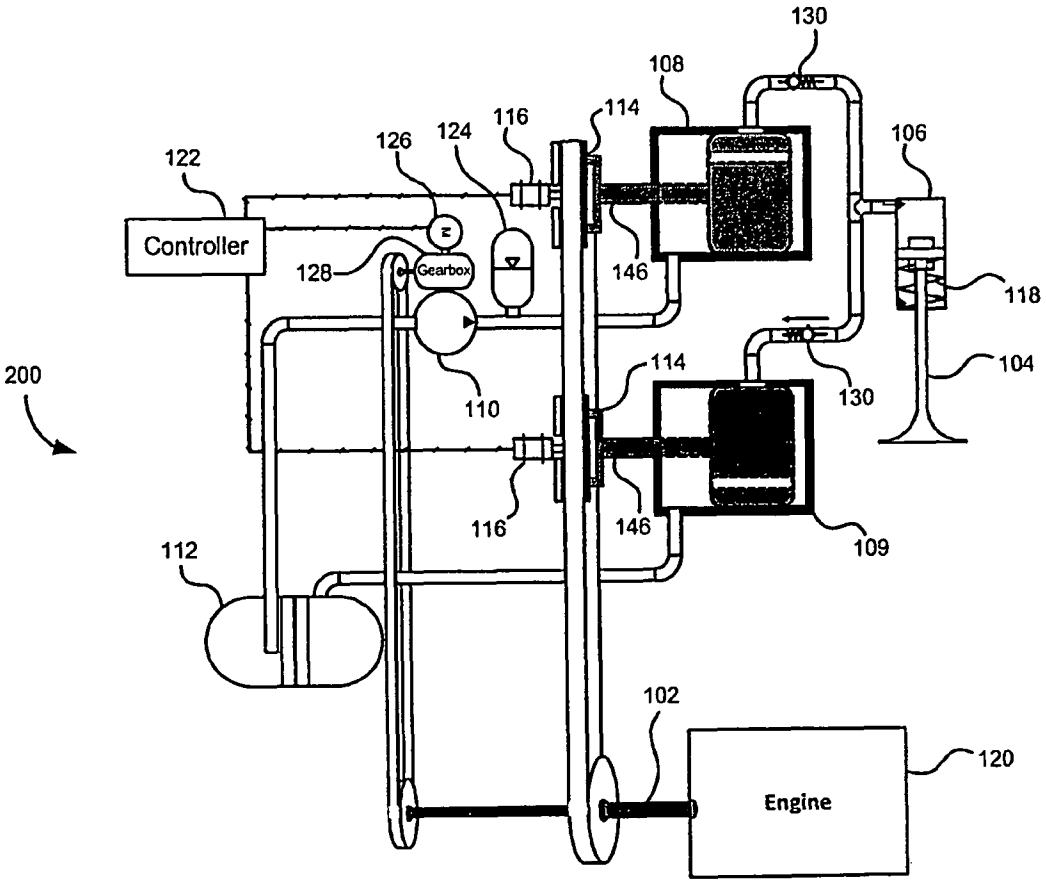
FIG. 2 is a diagram of a variable valve actuation system, in accordance with an embodiment.

FIG. 2 illustrates a schematic diagram of a VA system for a single engine valve. As discussed with respect to FIG. 1, the VA system 100 comprises a HPSV 108 and a LPSV 109. HPSV 108 and LPSV 109 are responsible for charging and discharging the hydraulic actuator, or cylinder 106. In this embodiment, the VA system 200 further comprises a hydraulic system which comprises at least a hydraulic pump 111 which transfers fuel from the tank 112 to the HPSV 108, an accumulator 124, the spool valves 108 and 109 and the hydraulic cylinder 106. The hydraulic pump, which may also be part of the high pressure fluid source 110, may be powered by the crankshaft through a gearbox 128 and its speed controlled by an electric motor 126. In the current embodiment, the gearbox 128 is connected to the engine crankshaft 102. The VA system 100 may also include a set of one way valves 130 to control the flow direction of the fluid being supplied to and bring removed from the hydraulic cylinder 106. A controller 122 may also be integrated within the system 100 to control the phase shifters 114 via the electric motor 126. In one embodiment, the control unit 122 is located within, or cooperates with the engine control unit of a vehicle.

In one mode of operation, the spool valves 108 and 109 obtain their rotary motion from the movement, or rotation, of the engine crankshaft 102 with their speeds being set such that they are half of the engine speed in four-stroke engines. Although the velocities of the spool valves 108 and 109 are proportional to the engine speed, their phases may be independently altered by two differential phase shifters 114 in order to provide further control of the system to the vehicle's electronic control unit (ECU). These phase shifters 114 are preferably electric and controlled, or powered, by the e-motor 116 but may also be hydraulic. The phase shifters 114 allow the angular position spools 108 and 109 to be flexibly changed. In order words, the angular position of an output shaft 146 (as shown in FIG. 3A) of the spool valves 108 and 109 may be changed with respect to its original position without changing the input/output speed ratio with respect to the engine.

Figure 3B:
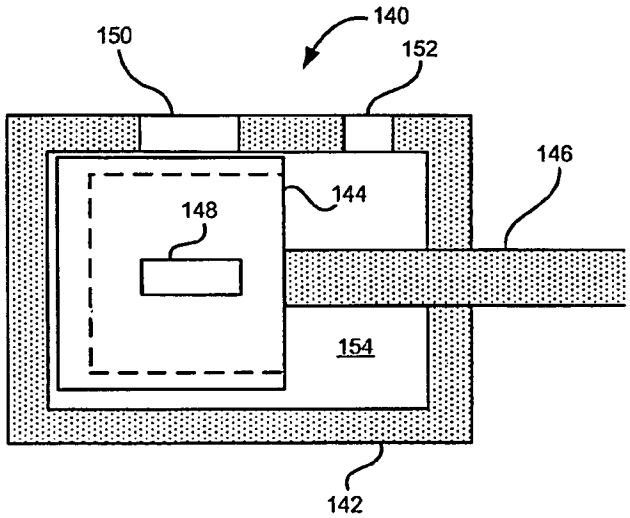
FIG. 3B is a sectional side view of a rotary spool valve, in accordance with an embodiment.
Figure 3A:
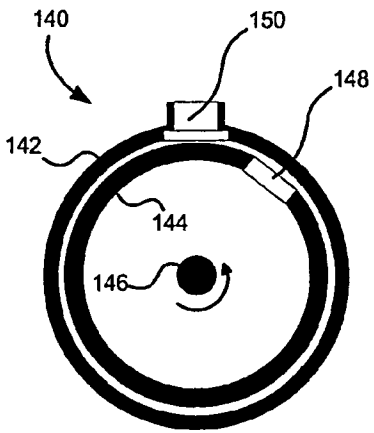
FIG. 3A is a sectional end view of a rotary spool valve, in accordance with an embodiment.
Figure 3C:
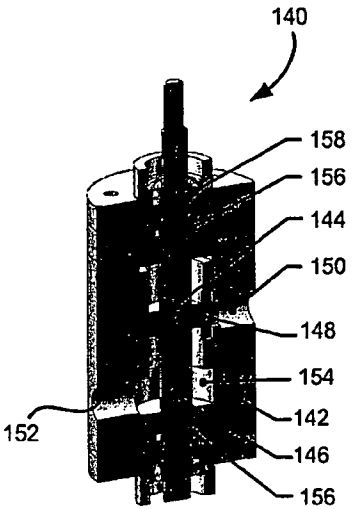
FIG. 3C is a sectional perspective view of a rotary spool valve, in accordance with an embodiment.

FIGS. 3A, 3B, and 3C provide various views of one example of a rotary spool valve in accordance with an embodiment. The rotary spool valve 140 may be used as the rotary spool valves 108 or 109 of system 100. FIG. 3A is a front view of a rotary valve, FIG. 3B is a side view of the rotary valve while FIG. 3B is a schematic view of the internal parts of the rotary valve.

As shown in FIG. 3A, the rotary spool valve 140 comprises a rotary spool portion 144 and a stationary casing 142 each of which has a respective opening 148 and 150. In the middle of the rotary spool valve 140, within an inner chamber 154 of the valve 140, is the spool shaft, which is connected to the phase shifter 114, or to the crankshaft 102 in the absence of the phase shifter 114.

As shown in FIG. 3*b*, if the rotary spool valve is the HPSV 108, the stationary casing 142 also includes a second opening 152 which is connected to, and receives fluid from, the tank 112, via the high pressure hydraulic source 110. If the rotary spool valve is the LPSV 108, the stationary casing 142 the second opening 152 is connected to, and transfers hydraulic fluid to, the tank 112. In each of the rotary valves, the opening 150 is connected to the hydraulic cylinder 106 for transmitting hydraulic fluid to, or receiving hydraulic fluid from the cylinder 106.

In operation, as the spool shaft 146 rotates the rotary spool portion 144, when the two openings 148 and 150 line up, fluid may be allowed to enter or exit the inner chamber 154, depending on the use of the rotary valve 140.

As shown in FIG. 3C, the rotary spool valve 140 may have bearings 158 that provide assistance for rotation of the spool shaft 146. The rotary spool valve 140 may have rotary seals 156 to ensure that the spool valve 140 does not leak hydraulic fluid from its inner chamber 154 and may be designed to increase spool valve flow while minimizing fluid friction forces and the size of the rotary spool valve 140.

Figure 4:
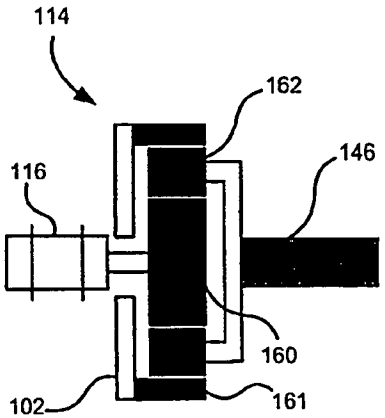
FIG. 4 is a side view of a differential phase shifter, in accordance with an embodiment.

FIG. 4 illustrates an embodiment of a differential phase shifter 114. Phase shifter 114 comprises a sun gear 160, a ring gear 161 and a carrier gear 162. The sun gear 160 is connected to the differential phase shifter controller 116, or e-motor. The ring gear 161 is connected to the crankshaft 102 of the engine 120 while the carrier gear 162 is connected to the spool shaft 146. A rotation of the sun gear 160 causes the spool shaft 146 to rotate relative to the crankshaft 102, thus creating a phase shift between the crankshaft 102 and the spool shaft 146. This phase shift modifies the relationship between the rotation of the crankshaft 102 relative to the engine valve 104. In an embodiment, any differential gearbox can be used to provide a phase shift in order to improve various characteristics of the automobile engine.

Figure 7:
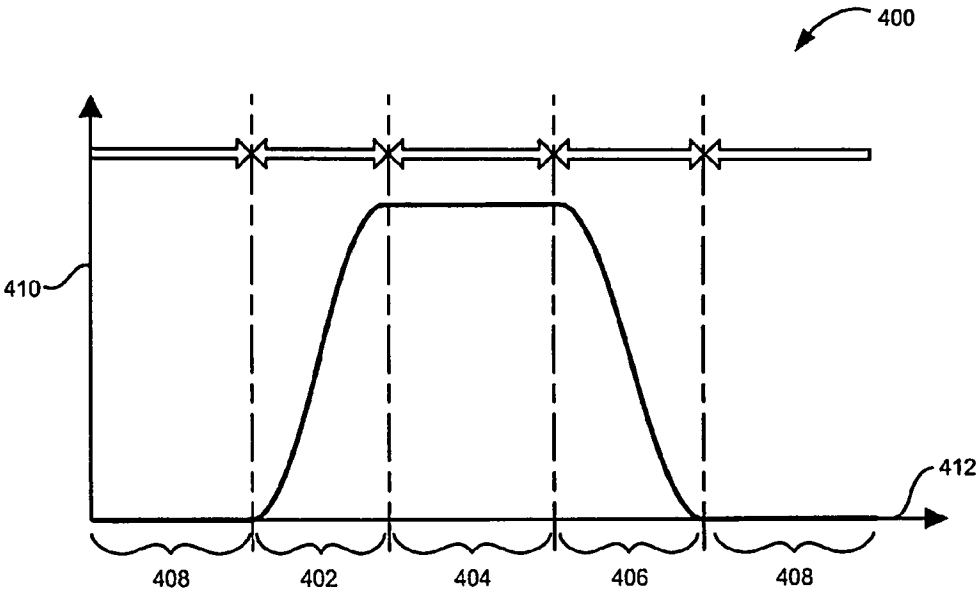
FIG. 7 is a graph of engine valve displacement, in accordance with an embodiment

In use, the engine valve 104 operation in every engine cycle is divided into four stages as schematically illustrated in FIG. 7. These stages include an opening stage, or state, 402, a stay open stage 404, a closing stage 406, and a stay closed stage 408. The chart of FIG. 7 displays an engine valve displacement or lift 410 (along the Y-axis) against the crankshaft angle over a rotation of the crankshaft 102 through two engine cycles, from 0 degrees to 720 degrees. VA system 100 can control each stage 402, 404, 406, 408 independent of the other operational stages 402, 404, 406, 408.

During the opening stage 402, when the opening or spool slot 148 of the high pressure spool valve (HPSV) 108 is lined up with the casing port 150 due to the rotation of the spool shaft 146 by the crankshaft 102 and engine, the high pressure hydraulic fluid from the high pressure hydraulic source 110 flows into the hydraulic actuator cylinder 106 pushing the piston down thereby actuating or opening the valve 104. The opening stage, or valve opening interval continues until there is no overlap area between the spool slot 148 and the casing port 150 of HPSV 108 thereby closing off the feed of hydraulic fluid from the inner chamber 154 to the actuator 106. As understood, the rotation of the spool shaft 146 controls the timing for when hydraulic fluid is available for the actuator 106 from the HPSV 108 and when the fluid supply for the hydraulic actuator 106 is closed. At this point, the final engine valve lift depends on the HPSV opening interval or length of time that hydraulic fluid is being supplied to the cylinder 106 and the hydraulic fluid supply pressure.

During the stay open stage 404, after the high pressure rotary spool valve 108 is closed (or when there is no overlap being the openings), the hydraulic fluid is trapped in a chamber within the hydraulic actuator 106 and the engine valve 104 stays open until the low pressure rotary spool valve (LPSV) 109 is opened such that the closing stage is reached.

During the closing stage 406, when the spool port 148 of the LPSV 109 is lined up with the casing port 150 due to the rotation of the crankshaft and the connection between the crankshaft and the rotary spool shaft 146 of the LPSV, the fluid that is within the hydraulic actuator 106 flows into the low pressure hydraulic source or tank 112. As the fluid exits the cylinder 106, the engine valve 104 starts to close due to the force of a return-spring 118 or may be closed using other known methods.

The engine valve closing interval, or stage, ends when the low pressure rotary spool valve 109 is closed (or when there is no overlap between the two openings of the LPSV 109) at which time, the force of the spring 118 should be high enough for full engine valve 104 closure. The hydraulic cylinder 106 is also equipped with a hydraulic cushion to avoid high contact velocity. During the stay closed stage 408, after the low pressure spool valve 109 is closed, the engine valve 104 remains closed until the HPSV 109 is opened again for the opening stage.

While the phase shifter may or may not be necessary to implement aspects of the disclosure, use of the phase shifters 114 allows the timing and length of the stages to be controlled.

Since the rotating velocities of rotary spool valves 108 and 109 are half of the engine speed, the valves open and close only once in every engine cycle. Hence, the engine valve operating frequency is passively controlled by the engine speed; however, the opening and closing timings along with opening duration could be actively controlled by phase shifting the HPSV 108 and LPSV 109. The engine valve opening and closing times remain constant when the phase shifters are idle.

One advantage of the system 100 with respect to existing systems include 0-720° flexibility in valve opening/closing timings at any operating condition; continuous valve lift variation (zero to maximum allowable valve lift) independent of the valve timing; no need to any solenoid actuator or servo valve; less expensive and simple components; and complete fail-safe system (system 100 continues operating with fixed timings and lift during electric power or any electric component failure).

Figure 5:
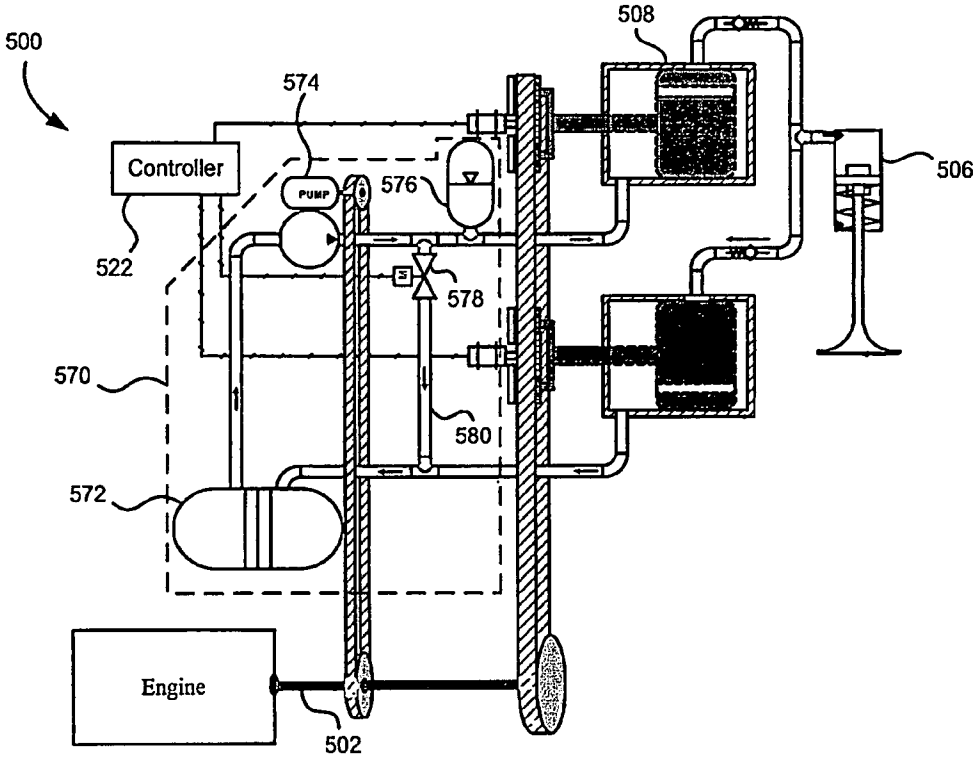
FIG. 5 is a diagram of a variable valve actuation system with a valve lift control mechanism, in accordance with an embodiment.

FIG. 5 illustrates a VA system 500 in accordance with another embodiment of the disclosure. The VA system 500 includes a pair of spool valves, seen as a HPSV 508 and a LPSV 509 along with a variable pressure hydraulic power unit 570. The variable pressure hydraulic power unit 570 is used to assist in maintaining a constant valve lift at different engine speeds. The hydraulic power unit 570 for the VA system 500 comprises an oil reservoir 572 or tank, a positive displacement pump 574 (such as a gear pump), and an air accumulator 576. The pump 574 is rotated by the engine crankshaft 504 through a mechanical transmission whose speed can be slightly varied using a variable speed gearbox. The speed of the pump 574 is adjusted in order to control or achieve the desired lift for the valve.

As the pump 574 runs continuously, the system upstream pressure increases when the HPSV 508 is fully closed since there is no release of hydraulic fluid from the HPSV 508 to the cylinder 506. During this period, the pumped fluid is stored in the accumulator 576. As the HPSV 508 opens, the pressurized fluid is discharged into the hydraulic cylinder 506, identical to the cylinder 106, and the upstream pressure decreases. In this embodiment, the pressure build up is used to replace the high pressure hydraulic source of system 100.

In addition to improving valve timing control, a precise engine valve lift control is beneficial in hydraulic valve systems where the engine valve lift is highly influenced by the upstream pressure, engine speed, and other disturbances. This is to reduce unwanted valve closure or mechanical interference between the valve and engine piston at different operating conditions. Moreover, several advantages such as significant reduction in pumping losses through throttle-less control of intake air and valve deactivation are also gained by varying the engine valve lift especially during low load engine operation.

The VA system 500 further comprises a variable valve lift controller 522 which assist in provided a desired engine valve lift which may be achieved using a lift control technique that controls the supply pressure, for example by using a lift controlling such as a proportional bleed-valve 578. In this case, the pressure which is built up when the HPSV is closed may be more closely controlled.

Unlike conventional electro-hydraulic camless valvetrains, the VA system 500, the duration of the HPSV 208 opening stage is proportional to engine speed and cannot be varied independently; thus, controlling the HPSV 508 upstream pressure will control the final engine valve lift. As such, the VA system 500 may be seen as being equipped with a lift control architecture, including a proportional bleed valve 578 and a drain line 580. As the bleed valve 278 opens, it drains a portion of the pumped fluid back to the oil reservoir 272 and consequently reduces the downstream pressure of the pump. Using this technique it is possible to achieve smaller engine valve lift at various engine speeds.

Figure 8:
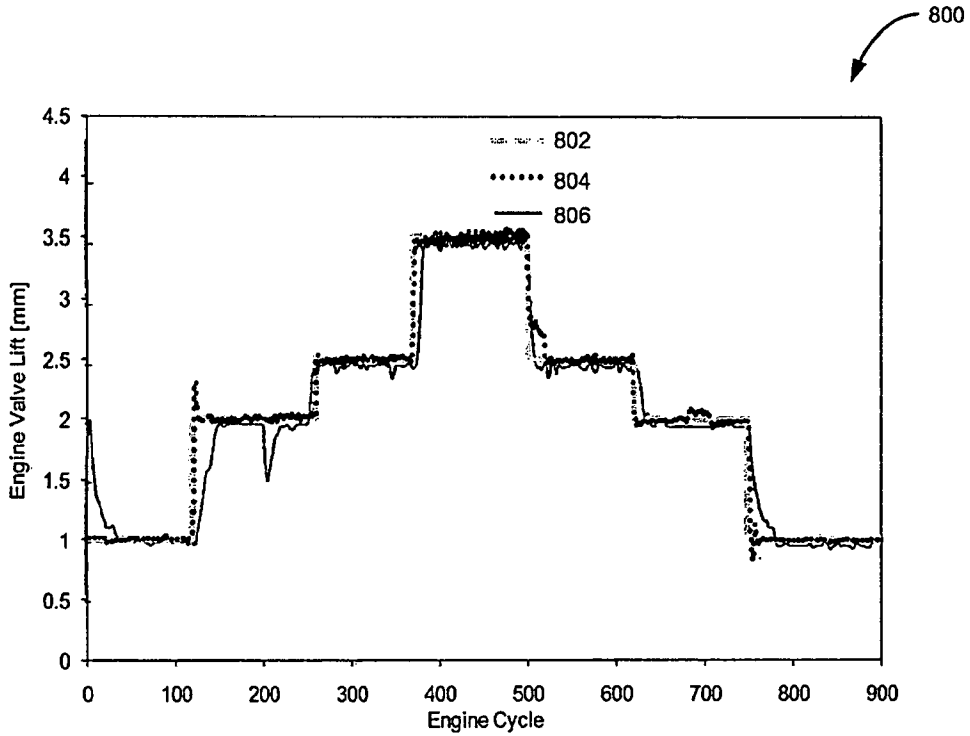
FIG. 8 is a chart showing experimental results of controlling engine valve lift using a variable valve actuation system.

FIG. 8 illustrates a chart 800 showing experimental results of controlling engine valve lift using the VA system 500. A reference lift 802 indicates the goal of the system. The actual lift 804 of VA system 500 is shown. Lift tor a traditional electro-hydraulic VA system 806 is shown.

Figure 6:
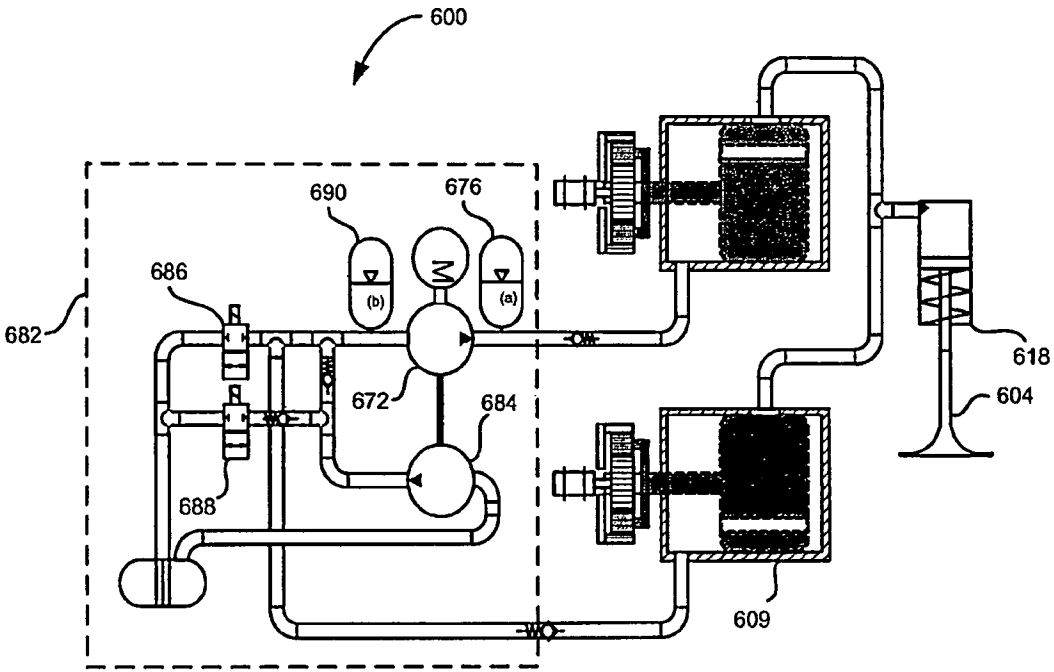
FIG. 6 is a diagram of a variable valve actuation system with an energy recovery system, in accordance with an embodiment.

FIG. 6 illustrates a VA system 600 in accordance with another embodiment. In this embodiment, the system 600 includes an energy recovery system 682 along with a HPSV 608 and a LPSV 609. The system sensitivity to engine cycle-to-cycle variation may be reduced by increasing the spring stiffness of spring 618 or hydraulic piston area. However, an increase in the values of these design parameters results in an increase in system power consumption. To reduce the tradeoff between system power consumption and robustness, an energy recovery system 682 is introduced.

Due to constant hydraulic piston area, LPSV 609 opening angle, spring stiffness and preload, the engine valve 604 full closure angle depends only on the engine speed. Thus in VA system 600, early valve closure can occur at lower engine speeds. In fact, during engine valve closing stage at lower engine speeds, only a portion of the available spring potential energy is used to discharge fluid from the hydraulic cylinder and the rest is wasted through the impact between the valve 604 and its seat or through the heat dissipation at hydraulic cushion which is used to control the engine valve seating velocity. To conserve the surplus spring potential energy during valve closing stage, the hydraulic power unit is equipped with the energy recovery system 682. Using energy recovery system 682, the main pump 672 upstream pressure (hydraulic cylinder downstream pressure) can be varied using a secondary hydraulic pump 684 coupled to the main pump shaft along with two on/off valves 686, 688. The engine valve actuator downstream pressure is regulated such that the surplus spring energy is used to maintain the main pump upstream pressure during engine valve operation. This will reduce the main pump 672 power consumption considerably. To this end, the pressure of an upstream accumulator 690 is increased by closing the digital valves 686, 688. This increase in the main pump upstream pressure continues as far as full engine valve closure is guaranteed. As the main pump upstream pressure is reached to a certain value, the digital valve 688 is opened. At this time, the pressure of the upstream accumulator 690 remains almost constant due to existence of unidirectional valve. The other on/off valve 686 is opened as soon as the return spring potential energy is not enough any longer for completely closing the engine valve 604.

Figure 9:
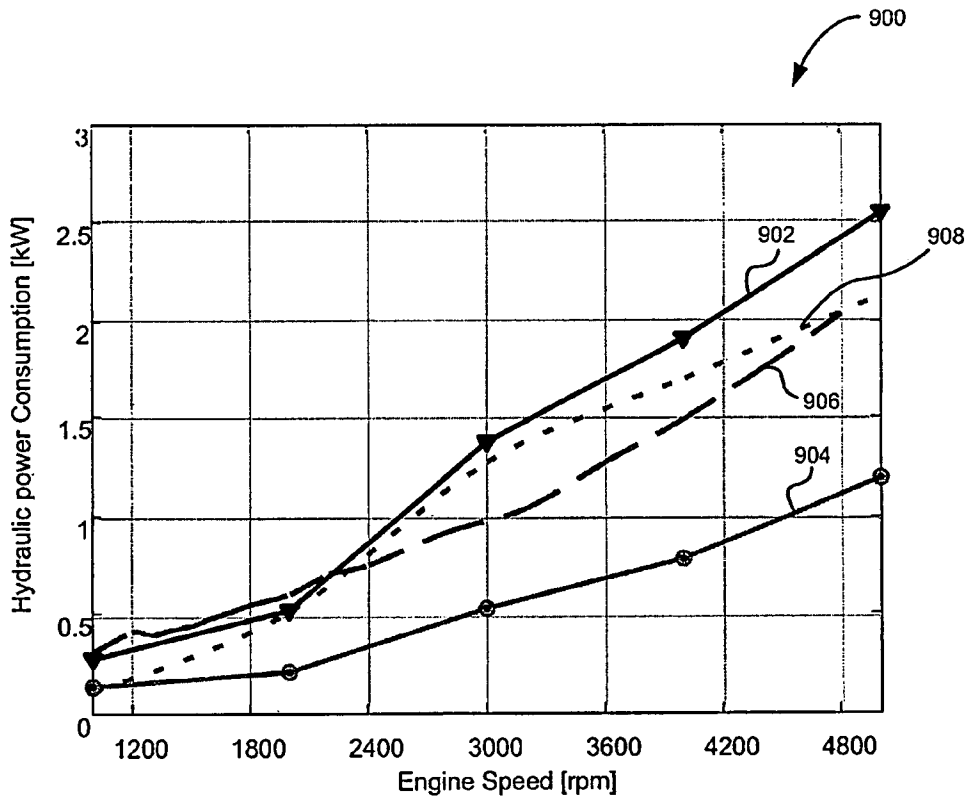
FIG. 9 is a chart showing a comparison of power consumption.

FIG. 9 illustrates a chart 900 showing a comparison of power consumption of different valve systems. The power consumption of VA system 500 is shown as a solid line 902 with triangular points while the power consumption of VA system 600 equipped with energy recover system 982 is shown in a solid line with circular dots. The power consumption of a conventional cam based system is also shown in long dashed lines while the power consumption of a traditional electro-hydraulic VA system is shown in short dashed lines.

Figure 10:
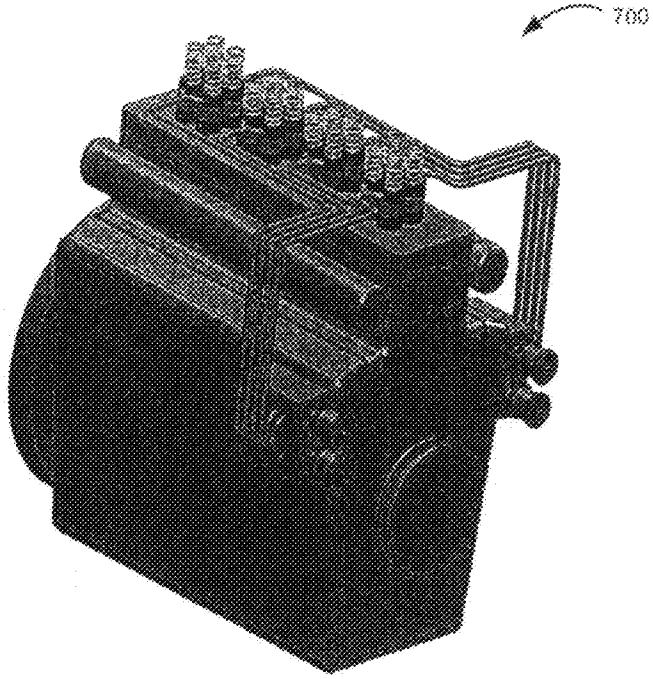
FIG. 10 is a perspective view of a 16 valves engine having a variable valve actuation system, in accordance with an embodiment.

FIG. 10 is a perspective view of an engine 700 equipped with VA system 100.

In certain embodiments the VA systems 100, 200, 500 or 600 may comprise means for adjusting the oil temperature and the hydraulic fluid viscosity to improve system performance and power consumption.

In certain embodiments, the VA systems 100, 200, 500 or 600 may be used with air hybrid engines to realize different modes of operation.

In the preceding description, for purposes of explanation, numerous details are set forth in order to provide a thorough understanding of the embodiments. However, it will be apparent to one skilled in the art that these specific details are not required. In other instances, well-known electrical structures and circuits are shown in block diagram form in order not to obscure the understanding. For example, specific details are not provided as to whether the embodiments described herein are implemented as a software routine, hardware circuit, firmware, or a combination thereof.

Embodiments of the disclosure can be represented as a computer program product stored in a machine-readable medium (also referred to as a computer-readable medium, a processor-readable medium, or a computer usable medium having a computer-readable program code embodied therein). The machine-readable medium can be any suitable tangible, non-transitory medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment of the disclosure. Those of ordinary skill in the art will appreciate that other instructions and operations necessary to implement the described implementations can also be stored on the machine-readable medium. The instructions stored on the machine-readable medium can be executed by a processor or other suitable processing device, and can interface with circuitry to perform the described tasks.

The above-described embodiments are intended to be examples only. Alterations, modifications and variations can be effected to the particular embodiments by those of skill in the art without departing from the scope, which is defined solely by the claims appended hereto.

What is claimed is:

1. A valvetrain actuation (VA) system for an engine comprising:

at least two hydraulic rotary valves connected to an engine crankshaft;

at least one hydraulic actuator driven by the at least two hydraulic rotary valves;

a high pressure hydraulic fluid source for supplying hydraulic fluid to one of the at least two hydraulic rotary valves; and individual phase shifters between the engine crankshaft and the at least two hydraulic rotary valves;

wherein movement of the at least two hydraulic rotary valves by the engine crankshaft allows hydraulic fluid to flow to the at least one hydraulic actuator to actuate an engine valve.

2. The VA system of claim 1 wherein a second of the at least two hydraulic rotary valves receives hydraulic fluid from the at least one hydraulic actuator.

3. The VA system of claim 2 wherein the hydraulic rotary valves are rotary spool valves.

4. The VA system of claim 2 further comprising an oil reservoir for receiving the hydraulic fluid from the second hydraulic rotary valve.

5. The VA system of claim 4 wherein the oil reservoir is connected with the high pressure hydraulic fluid source via a hydraulic pump.

6. The VA system of Claim 1 wherein each individual phase shifter is a differential gearbox.

7. The VA system of claim 6 wherein the differential gearbox is driven by an input from the engine and an input from an electric motor.

8. The VA system of claim 1 further comprising a lift controller for controlling hydraulic pressure of the hydraulic fluid source to adjust a lift of the engine valve.

9. A method of hydraulically controlling an engine valve comprising:

supplying pressurized hydraulic fluid to one of at least two hydraulic rotary valves;

driving the at least two hydraulic rotary valves with an engine crankshaft;

phase shifting the at least two hydraulic rotary valves;

wherein the driving of the at least two hydraulic rotary valves causes the one of the at least two hydraulic rotary valves to supply the hydraulic fluid to at least one hydraulic actuator to actuate an engine valve in a first direction.

10. The method of claim 9 further comprising:

receiving the hydraulic fluid from the at least one hydraulic actuator at a second of the at least two hydraulic rotary valves allowing the at least one hydraulic actuator to actuate the engine valve in a direction opposite the first direction; and transmitting the hydraulic fluid from the second hydraulic rotary valve to an oil reservoir.

11. The method of claim 9 further comprising, before supplying pressurized hydraulic fluid, controlling a pressure level of the pressurized hydraulic fluid.

12. The method of claim 9 further comprising, after supplying the hydraulic fluid to the at least one hydraulic actuator, stopping the flow of hydraulic fluid via movement of the engine crankshaft.

13. The method of claim 12 further comprising:

driving a second of the at least two hydraulic rotary valves, in a low pressure environment, to receive hydraulic fluid from the at least one hydraulic actuator.

14. The method of claim 13 wherein driving the second of the at least two hydraulic rotary valves occurs concurrently with stopping the flow of hydraulic fluid.

15. The method of claim 13 wherein driving the second of the at least two hydraulic rotary valves occurs after stopping the flow of hydraulic fluid.

* * * * *